United States Patent [19]

Anastasia

[11] Patent Number: 4,776,774

[45] Date of Patent: Oct. 11, 1988

[54] HYDRAULIC DOUBLE-ACTING HYDROPNEUMATIC PRESSURE MULTIPLYING DEVICE

[76] Inventor: Julio C. Anastasia, Pasaje Courel 783, Cordoba, Argentina

[21] Appl. No.: 884,370

[22] Filed: Jul. 11, 1986

[30] Foreign Application Priority Data

Jul. 17, 1985 [AR] Argentina ..... 301,007

[51] Int. Cl.[4] ..... F04B 9/08; F04B 35/00

[52] U.S. Cl. ..... 417/400; 417/388; 60/588; 60/593

[58] Field of Search ..... 417/383–388, 417/395, 400; 60/593, 588, 589

[56] References Cited

U.S. PATENT DOCUMENTS

| | | | |
|---|---|---|---|
| 3,174,432 | 3/1965 | Eickmann | 417/400 |
| 3,306,042 | 2/1967 | Crooks | 417/387 |
| 3,713,755 | 1/1973 | Scheffer | 417/400 |
| 3,790,310 | 2/1974 | Whelan | 417/388 |
| 3,839,866 | 10/1974 | Seidel | 60/593 |

*Primary Examiner*—Carlton R. Croyle

*Assistant Examiner*—Jane E. Obee

*Attorney, Agent, or Firm*—Fleit, Jacobson, Cohn & Price

[57] ABSTRACT

In a hydraulic double-acting hydropneumatic pressure multiplying device suited for generating hydraulic pressure, and comprising a cylinder within which a piston is slidably mounted. The multiplying device is capable of generating hydraulic pressure in both the backward and forward strokes of the piston within the cylinder. For this purpose, the cylinder is closed at the bottom by a lower cap having an upwardly extending plunger received within a portion extending upwardly from the piston. The cylinder also provides an upper cap with a dome and the upwardly extending portion of the piston is reciprocating within this dome, thus defining between the portion of the piston and the dome a first pressure generating chamber, and within the upwardly extending portion of the piston and the plunger of the lower cap a second pressure generating chamber for obtaining hydraulic pressure in both of the strokes of the piston. Conduits and valves are also supplied for compensating the volumetrical variations in the respective chambers.

10 Claims, 1 Drawing Sheet

29
18
L
16
17
27d
19
20
27c
15
14
20a
21
22
12
13
23
A
A
1
27b
11
27
27a
28
10
24
9
25
3
7
9a
18
26
6
5
4a
4
1a
2

HYDRAULIC DOUBLE-ACTING HYDROPNEUMATIC PRESSURE MULTIPLYING DEVICE

FIELD OF THE INVENTION

The present invention relates to a hydraulic double-acting hydropneumatic pressure multiplying device, particularly suited for generating hydraulic pressure.

Hydraulic pressure multiplying devices are broadly utilized in hydraulic systems for obtaining mechanical movement of several apparatus, where the hydraulic fluid is utilized to obtain mechanical movement of some part of a mechanical system. The pressure multiplyer has a piston driven by a pneumatic branch for multiplying the hydraulic pressure during one of the piston strokes, generally considered the forward stroke, to generate energy for the system. An application of the pressure multiplying device of the invention is in tool machinery, particularly to operate gripping means thereof for fastening the art to be machined.

BACKGROUND OF THE INVENTION

A known multiplying device includes a pneumatic cylinder which is filled by pressurized fluid in order to move a reciprocating piston. The bottom of the cylinder is closed by a lower cap. Nevertheless, most of such pressure multiplying devices comprise piston-cylinder assemblies capable of generating hydraulic pressure in only one of the two strokes of the piston. The multiplying devices, through structural limitations, only produce pressure during either the back-stroke or the forward stroke, but never in both successive piston strokes.

As stated before, the prior art hydraulic pressure multiplying devices were used to generate pressure in only one stroke of the piston. This results in several disadvantages, one of which is that the pressurized flow has a rather low frequency cycle. Furthermore the single-effect pressure multiplying devices of the prior art, which are used for operating the crimping means of tool machines, are provided with strong springs for driving the fluid compressing piston in its backward stroke. This is neccesary for allowing the crimping means to come to its rest position for releasing the piece already machined. Sometimes it is necessary to provide big and heavy springs, and the space or volume they occupy may be considerable.

SUMMARY OF THE INVENTION

An object of the present invention is to provide a pressure multiplying device which generates increasing pressure in both strokes of a pneumatic piston, and which easily and economically utilizes the same structure of the hydropneumatic multiplying devices which are presently being used.

The hydraulic pressure may be thus obtained in a first and then in a successive second stroke of the piston. The hydraulic pressure obtained in the second stroke may be equal, higher or lower than the hydraulic pressure value which is obtained by the first stroke, by varying the design of the multiplication ratio. Furthermore, the hydraulic pressure may be regulated in accordance with the different applications through the use of a pressure regulating valve.

Briefly, the multiplying device of the present invention utilizes the basic structure of a known multiplying device and is improved by the following technical features to overcome the above mentioned drawbacks.

In accordance with the present invention, the lower cap includes a plunger upwardly extending into the cylinder, which it utilized to recover hydraulic energy from the second or backward stroke of the piston of the multiplying device. On the other hand, the hydraulic compressing piston acts on a compressing chamber to obtain a hydraulic pressure from a forward stroke which is also called a first pressure effect, and then to obtain hydraulic pressure during the backward or reverse stroke which is also called a second pressure effect. The hydraulic fluid, which is circulating within the circuit defined inside the multiplying device, may be supplied from outside or inside the device. This will depend on the necessary liquid volume or on the required multiplying rate.

The hydraulic circuit includes two valves, one of which is a check-valve or non-return valve and the other is a pressure regulating valve, as well as the pertinent connecting conduits forming the circuits.

The pressure multiplying device of the present invention produces an economical saving due to the recovering of the pneumatic energy in the backward stroke of the pneumatic piston which is presently not utilized by the known multiplying devices for this purpose.

DETAILED DESCRIPTION OF THE PREFERRED EMBODIMENT

Figure 1:
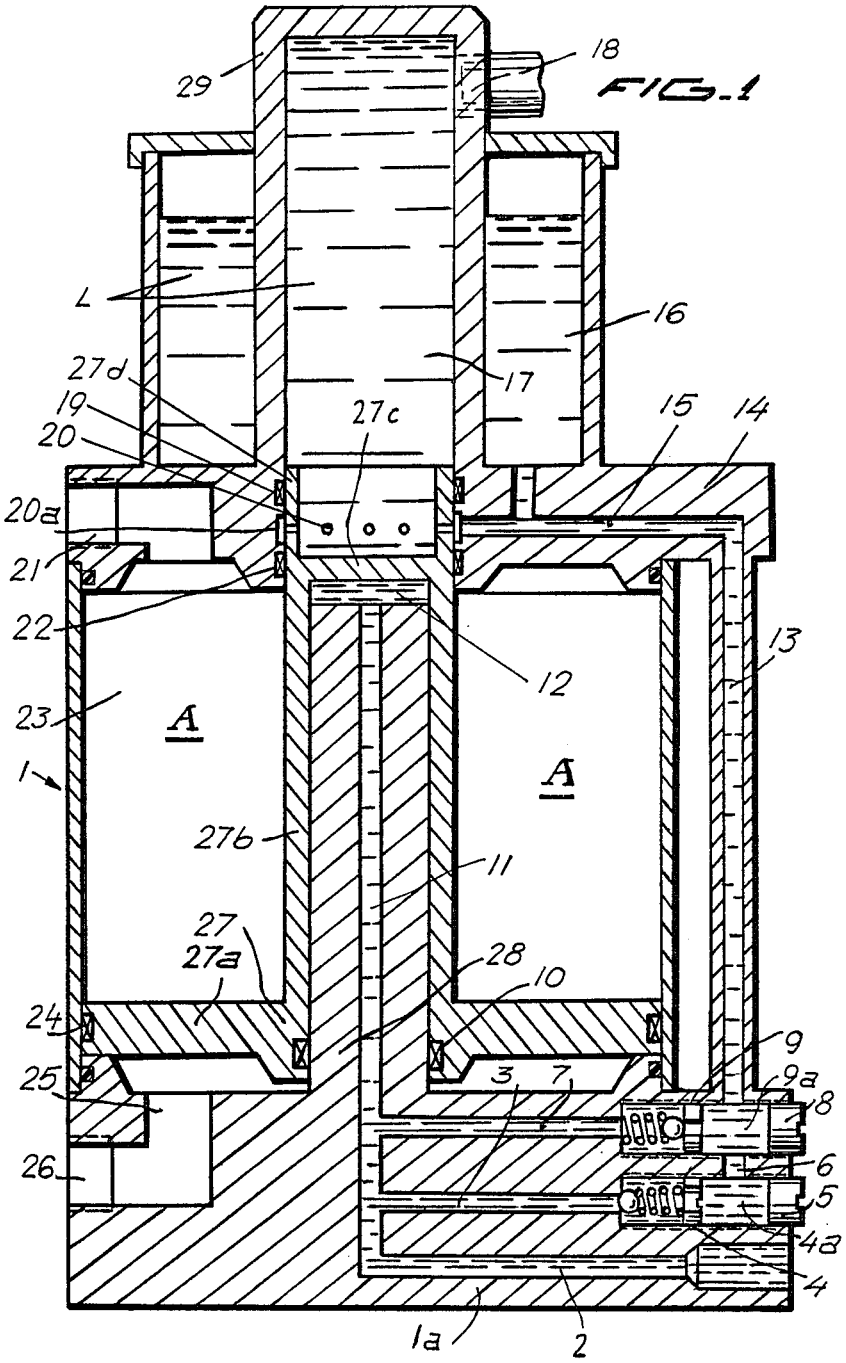
FIG. 1 illustrates a longitudinal section taken along a medium plane through the device of the present invention.

The present multiplying device is formed by a pneumatic cylinder, closed at the bottom thereof by a lower cap 1*a*. The cap 1*a* includes a conduit 2 for the passage of pressurized liquid, which is obtained from the backward stroke of the piston, also called second pressure effect. Adjacent the first conduit 2 there is provided a second conduit 3, where a pressure regulating valve 4 is mounted. The second conduit 3 is closed at an opening thereof, in the periphery of the cylinder 1, by a closing plug 5. The second conduit 3 is connected, at the zone between the valve 4 and the plug 5, through a bore 6 with a housing 9*a* of a check-valve 9 which is arranged at an end of a third conduit 7.

The cap 1*a* includes a plunger 28 which upwardly extends from an upper surface of the cap and includes a central bore 11 which is formed to coincide with a longitudinal axis of the plunger 28. The central bore 11 is connected simultaneously with the first, the second and the third conduits 2, 3, 7 at a lower end thereof. The central bore 11 ends at an upper end of the plunger 28 and is opened particularly to a liquid compression chamber 12, also called second chamber, formed between the plunger 28 and a closed end 27*c* of a double acting piston 27. The piston 27 is formed by a lower plate portion 27*a*, connected to an upwardly extending portion 27*b*. Extending upwardly from the closed end 27*c* of piston 27 is a cup 27*d* which includes openings 20 formed therein for a purpose which will later become clear. The plunger 11 is closely slidable mounted within the upwardly extending portion 27*b* and the chamber 12 is formed between the exterior surface of the plunger 11 and the interior wall of the portion 27*b*.

In order to obtain a closing interface between the plunger 28 and the portion 27*b*, a seal member 10 is provided to form a separation between the liquid L to be compressed and the driving air A which acts on the piston 27.

The lower plate portion 27*a* of the piston 27 includes a peripheral seal member 24 for closing the interface between this portion 27*a* and the inner wall of the cylinder 1. Thus, at both sides of the piston 27, two acting chambers 23, 25 are formed for compressed air which in turn are connected, through pertinent conduits 21,26, to a compressed air supply.

In the upper portion of the cylinder 1 there is provided a container 16 located on a upper cap 14 of the pneumatic cylinder 1. The container 16 is connected through a bore 15 with a conduit 13 which in turn is connected with the valve housings 9*a* and 4*a*. The bore 15 includes in one end, opposite to the end connected to the conduit 13, a peripheral groove 20*a* which is in turn connected with openings 20 formed in the cup 27*d* of the piston 27. The openings 20 are alighed with the groove 20*a* when the piston 27 is in its lower position, as shown in FIG. 1.

A liquid pressurizing chamber 17, also called a first chamber, is formed within a dome 29 which extends upwardly from the upper cap 14 and within the container 16. The upwardly extending portion 27*b* of the piston 27 is movably received within the dome 29, and this portion 27*b* acts as a piston within the chamber 17 in order to pressurize the fluid L and produce a pressure generated through the orifice 18. This in turn is connected with the pertinent branch of the hydraulic circuit in which the multiplying device of the present invention is arranged.

On an upper end of the portion 27*b*, a fluid seal member 19 is provided to seal the interface between the portion 27*b* and the inner wall of the dome 29 in order to avoid any fluid drop. An additional seal member 22 is provided adjacently the seal member 19, at the other side of the opening 20, in order to close the upper zone of chamber 23.

The fluid pressurized multiplying device of the present invention functions as follows: assuming that the elements of the device are at a first position, shown in FIG. 1, the container 16 is full of liquid and chamber 23 is full of compressed air, i.e. the double acting piston is resting against the lower cap 1*a*. Hydraulic pressure is generated by the instant device during a first and a second pressure effects. In order to generate hydraulic pressure in the first pressure effect, the compressed air or chamber 23 is allowed to exit through opening 21 and compressed air is fed to chamber 25 through the opening 26, thus producing the upward movement of the piston 27 which will introduce the portion 27*b* within the compression chamber 17. Once the openings 20, during upward movement of the portion 27*b*, pass behind the seal member 19, the pressure within the chamber 17 will increase and pressurized fluid will be fed through the orifice 18 during the first pressure effect, which pressurized fluid will be utilized to obtain the necessary work. During the movement of the piston 27 over the plunger 28, the volume within the compression chamber 12 will increase due to the closing action of the seal means 20, and the extra volume will be occupied by liquid entering from conduit 2, after said liquid has carried out a predetermined work. When this volume can not be totally covered by the liquid provided by conduit 2, the necessary liquid will be supplied by the container 16 through conduits 7, 13, and 15, which liquid will pass through the check-valve 9.

In order to generate hydraulic pressure during the second pressure effect, it is necessary to allow the air residing in chamber 25 to escape through opening 26, and compressed air will be fed through conduit 21 into chamber 23 in order to move the piston 27 downwardly. Thus, the volume of the liquid in compression chamber 17 will increase and the chamber 17 will be occupied by fluid from the hydraulic circuit, through the orifice 18. In case there is not sufficient liquid to replace the volume evacuated by portion 27*b*, when openings 20 reach the groove 20*a*, the necessary liquid will be supplied by the container 16, through the bore 15, the groove 20*a*, and openings 20 and into the chamber 17.

Simultaneously, during the backward stroke of piston 27, the pressure within chamber 12 will be increased, and therefore pressurized fluid will be supplied through the central bore 11. This pressurized fluid will be circulated through the conduit 2, and into the pertinent branch of the hydraulic circuit to be applied to effect a predetermined work.

In all the cases, the double acting piston 27 has to make contact with the upper surface of the lower cap 1*a* in order to compensate the volume variation of the compressing chamber 17 achieved by means of the coincidence between openings 20 and the groove 20*a*. In order to attain this, it is necessary to adjust the pressure regulating valve 4 for allowing the pressurized fluid not used to effect the necessary work in the hydraulic circuit to escape through this valve 4. If all the pressurized fluid is not used, then the increasing pressure within the central bore 11 will open the pressure regulating valve 4 and the fluid, passing through valve 4, will be conducted through conduits 6, 7, 13 and 15.

Although the essential features of the invention have been brought out by means of a preferred embodiment, the invention is not limited to this embodiment and extends on the contrary to all alternative forms within the purview of the appended claims.

I claim:

1. A hydraulic pressure multiplying device comprising:

a cylinder including an inner wall forming a first chamber, an upper cap defining an opening closing the upper end of the first chamber, a lower cap closing the lower end of the first chamber, and inlet and outlet means at each end of said first chamber;

a hollow dome, having a closed upper end, connected to the upper cap defining a second chamber communicating with said opening in said upper cap;

a double acting piston reciprocally movable within said first chamber and including an upwardly extending tubular portion closed at its upper end and open at its lower end, said closed upper end slidably mounted to pass through said opening in said upper cap and into said hollow dome;

plunger means extending upwardly from said lower cap and relatively slidingly received in said upwardly extending tubular portion to define a third chamber;

inlet-outlet means communicating with the top of said hollow dome and with the bottom of said third chamber;

a fourth chamber for holding a fluid source;

communication means for communicating said fourth chamber with said second chamber when said upwardly extending tubular portion slides out of said second chamber and with said third chamber during sliding movement of said upwardly extending tubular portion into said second chamber.

2. A hydraulic pressure multiplying device according to claim 1 wherein said communication means further communicates said third chamber with said fourth chamber during sliding movement of said upwardly extending tubular portion out of said second chamber.

3. A hydraulic pressure multiplying device according to claim 1 wherein said upwardly extending tubular portion includes an annular flange extending upwardly from its upper end, and wherein said communication means includes openings in said annular flange that register with openings in said upper cap leading to a bore communicating with said fourth chamber.

4. A hydraulic pressure multiplying device according to claim 1 wherein said hollow dome is cylindrical and has a central axis, and wherein said fourth chamber is an annular container mounted coaxilly with said hollow dome.

5. A hydraulic pressure multiplying device according to claim 1 wherein the inlet and outlet means at each end of said first chamber includes openings formed in said upper cap and in said lower cap, respectively, to allow compressed air to be supplied to and exit from said first chamber to reciprocally move said double acting piston within said first chamber.

6. A hydraulic pressure multiplying device according to claim 1 wherein said inlet-outlet means communicating with the bottom of said third chamber comprises a central bore extending through said lower cap and said plunger means to said third chamber.

7. A hydraulic pressure multiplying device according to claim 6 wherein said communication means includes first and second conduits defined in said lower cap and a third conduit leading from said lower cap to said fourth chamber, said first and second conduits interconnecting said central bore and said third conduit.

8. A hydraulic pressure multiplying device according to claim 7 wherein a check valve is positioned in said first conduit allowing unidirectional fluid flow from said fourth chamber through said third conduit to said central bore.

9. A hydraulic pressure multiplying device according to claim 8 wherein a pressure regulating valve is provided in said second conduit relieving excess pressure in said third chamber through said central bore and said third conduit to said fourth chamber.

10. A hydraulic pressure multiplying device comprising:

a cylinder including an inner wall forming a first chamber, an upper cap defining an opening closing the upper end of the first chamber, a lower cap closing the lower end of the first chamber, and inlet and outlet openings at each end of said first chamber to admit and exhaust compressed fluid;

a cylindrical hollow dome having a closed upper end connected to the upper cap defining a second chamber communicating with said opening in said upper cap;

a double acting piston reciprocally movable within said first chamber and including an upwardly extending tube closed at its upper end and open at its lower end, said closed upper end slidably mounted to pass through said opening in said upper cap and into said hollow dome;

a plunger extending upwardly from said lower cap and relatively slidingly received in said upwardly extending tube to define a third chamber;

a first orifice communicating with the top of said hollow dome;

an annular container coaxially surrounding said dome and defining a fourth chamber for holding a fluid source;

a second orifice defined by said lower cap;

said plunger defining a central bore communicating with said third chamber and said second orifice;

an upwardly extending cup attached to the top closed end of said tube;

a first conduit communicating with said fourth chamber;

a second conduit communicating with said first conduit and said central bore;

a third conduit communicating with said first conduit and said central bore;

a check valve in said second conduit allowing flow toward said central bore;

a pressure regulating valve relieving excess pressure from said central bore to said first conduit;

a fourth conduit communicating with said first conduit; and a series of holes defined by said cup communicating with said fourth conduit when said tube is in its fully retracted position relative to said dome.

* * * * *